US006267335B1

(12) United States Patent
Barrett

(10) Patent No.: US 6,267,335 B1
(45) Date of Patent: Jul. 31, 2001

(54) HUNTERS ARM REST

(76) Inventor: James K. Barrett, 919 Fleming St., Coraopolis, PA (US) 15108

( * ) Notice: Subject to any disclaimer, the term of this patent is extended or adjusted under 35 U.S.C. 154(b) by 40 days.

(21) Appl. No.: 08/944,371

(22) Filed: Oct. 6, 1997

(51) Int. Cl.[7] ..... B68G 5/00; F41A 29/00
(52) U.S. Cl. ..... 248/118; 42/94
(58) Field of Search ..... 248/118, 118.3, 248/205.2, 218.4, 219.4, 230.9, 304.1, 354.4; 124/86; 42/94; 224/913

(56) References Cited

U.S. PATENT DOCUMENTS

| | | | | |
|---|---|---|---|---|
| 454,300 | * | 6/1891 | Sproul | 42/94 |
| 759,593 | * | 5/1904 | Cover | 42/94 |
| 3,191,826 | * | 6/1965 | Adams | 224/5 |
| 3,390,477 | * | 7/1968 | Galbraith | 42/94 |
| 3,584,821 | * | 6/1971 | Glebe | 248/156 |
| 4,844,390 | * | 7/1989 | Duke | 248/118 |
| 4,893,427 | * | 1/1990 | Davidson | 42/94 |
| 5,345,706 | * | 9/1994 | Brown | 42/94 |
| 5,351,867 | * | 10/1994 | Vest | 224/224 |
| 5,487,374 | * | 1/1996 | Herminath et al. | 124/86 |
| 5,509,400 | * | 4/1996 | Chalin | 124/86 |
| 5,528,846 | * | 6/1996 | Baggett | 42/94 |
| 5,735,496 | * | 4/1998 | Dube | 248/118 |

* cited by examiner

*Primary Examiner*—Anita M. King
(74) *Attorney, Agent, or Firm*—Webb Ziesenheim Logsdon Orkin & Hanson, P.C.

(57) ABSTRACT

A portable hunters armrest is useable with a wide variety of weaponry. The hunters armrest includes a base rod having a first end and an opposed second end with a strap coupled to the first end of the base rod. The strap is adapted to attach the hunters armrest to the hunter. At least one upper rod is adjustably attached to the second end of the base rod. Each upper rod has an armrest member at a distal end thereof. A plurality of upper rods may be provided usable with the base rod with each upper rod having a distinct armrest member thereon.

11 Claims, 5 Drawing Sheets

HUNTERS ARM REST

BACKGROUND OF THE INVENTION

1. Field of the Invention

The present invention relates to an arm rest, more particularly, the present invention relates to a portable arm rest worn by the user for steadying a pistol, rifle, bow or the like.

2. Background Information

Accuracy in shooting most hand held weapons is improved with the steadying of the weapon and/or the user's arm. A wide variety of supports have been developed to assist in this matter. Many of these supports are comprised of multi-legged structures which attach directly to the weapon, e.g. rifle tripods. These structures are often very cumbersome and can inappropriately limit or hinder the mobility of the user. Hunters, for example, will find it difficult to accommodate a separate large gun support. This can be particularly true where the hunter is perched in a tree stand or the like. -These prior art supports are often limited to a single type of weapon, minimizing their usefulness to the avid sportsman.

It is an object of the present invention to overcome the aforementioned problems of the prior art and to provide a portable hunters arm rest useable with a wide variety of weaponry. A further object of the present invention is to provide a hunters armrest which is easy to use and easy and economical to manufacture.

SUMMARY OF THE INVENTION

The above objects are achieved with a hunters arm rest according to the present invention. The hunters armrest includes a base rod having a first end and an opposed second end. A strap is coupled to the first end of the base and is adapted to attach the hunters armrest to the hunter. At least one upper rod is provided having an armrest member at one end thereof. Each upper rod is adapted to be adjustably attached to a second end of the base rod.

In a preferred embodiment of the present invention, the strap will extend through the first end of the base rod and the upper rod and will be telescopically received within the second end of the base rod. The strap which extends from the first end of the base rod and around the hunter will pivotably support the base rod relative to the hunter.

One embodiment of the present invention includes two separate upper rods with each upper rod having a different armrest member. A first upper rod may have an armrest member formed as a substantially spherical ball. The second upper rod may include an armrest member which bends away from the longitudinal axis of the base rod and includes a concave member.

These and other advantages of the present invention will be clarified in the description of the preferred embodiment taken together with the attached figures wherein like reference numerals represent like elements as well.

DESCRIPTION OF THE PREFERRED EMBODIMENT

A hunters armrest 10 according to the present invention is illustrated in the figures. As will be evidenced hereinafter, the hunters armrest 10 of the present invention is particularly useful for steadying a hunter's aim. However, it should be understood that the present invention is not limited to use by hunters or even to use by sportsmen. The hunters armrest 10 of the present invention can be used generally as a hand or arm support worn by the user for use in remote locations. Other applications may arise such as steadying photographic or other optical equipment.

The hunters armrest 10 of the present invention includes a base rod 12 with a rubber cap 14 at a first end thereof. The base rod 12 may be made out of a steel or other appropriate material giving appropriate strength to the hunters armrest 10. The rubber cap 14 provides an ergonomic support for resting the hunters armrest 10 against the body of the user. The cap 14 additionally provides a broadened base for the base rod 12 to distribute the forces over a wider area against the user as will become obvious in the description of use of the hunters armrest 10. A strap 16 extends through the base rod 12 and cap 14. The strap 16 encircles the user to attach the hunters armrest 10 to the user, preferably around the waist of the user. The strap 16 may be formed out of any conventional material sufficient for attachment to the user, such as leather.

Figures 1A, 1B:
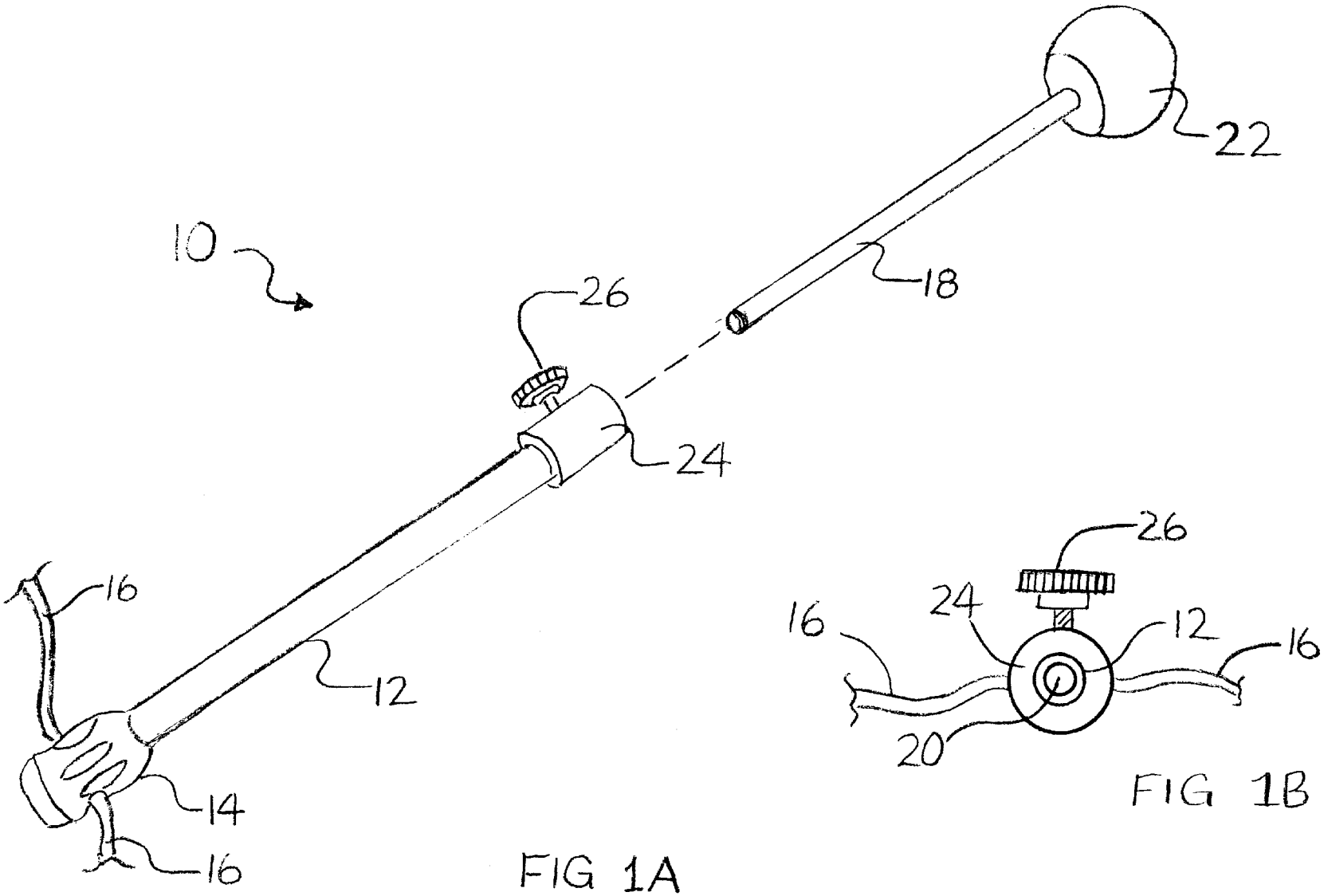
FIG. 1*a* is a perspective view of a base rod and one upper rod forming a hunters armrest according to the present invention.
FIG. 1*b* is an end view of the base rod illustrated in FIG. 1*a;*

The base rod 12 is hollow as best shown in FIG. 1*b*. A first upper rod 18 is telescopingly received in the hollow interior 20 of the base rod 12 at the second end of the base rod 12 spaced from the cap 14. The first upper rod 18 includes a substantially spherical armrest member 22 at the distal end thereof. The base rod 12 includes an enlarged mounting portion 24 at the second end thereof to receive a set screw 26 therethrough. The set screw 26 communicates with the hollow interior 20 of the base rod 12 such that the set screw 26 bears against the first upper rod 18 when the first upper rod 18 is received therein to lock a first upper rod 18 in an appropriate position relative to the base rod 12.

Figure 3:
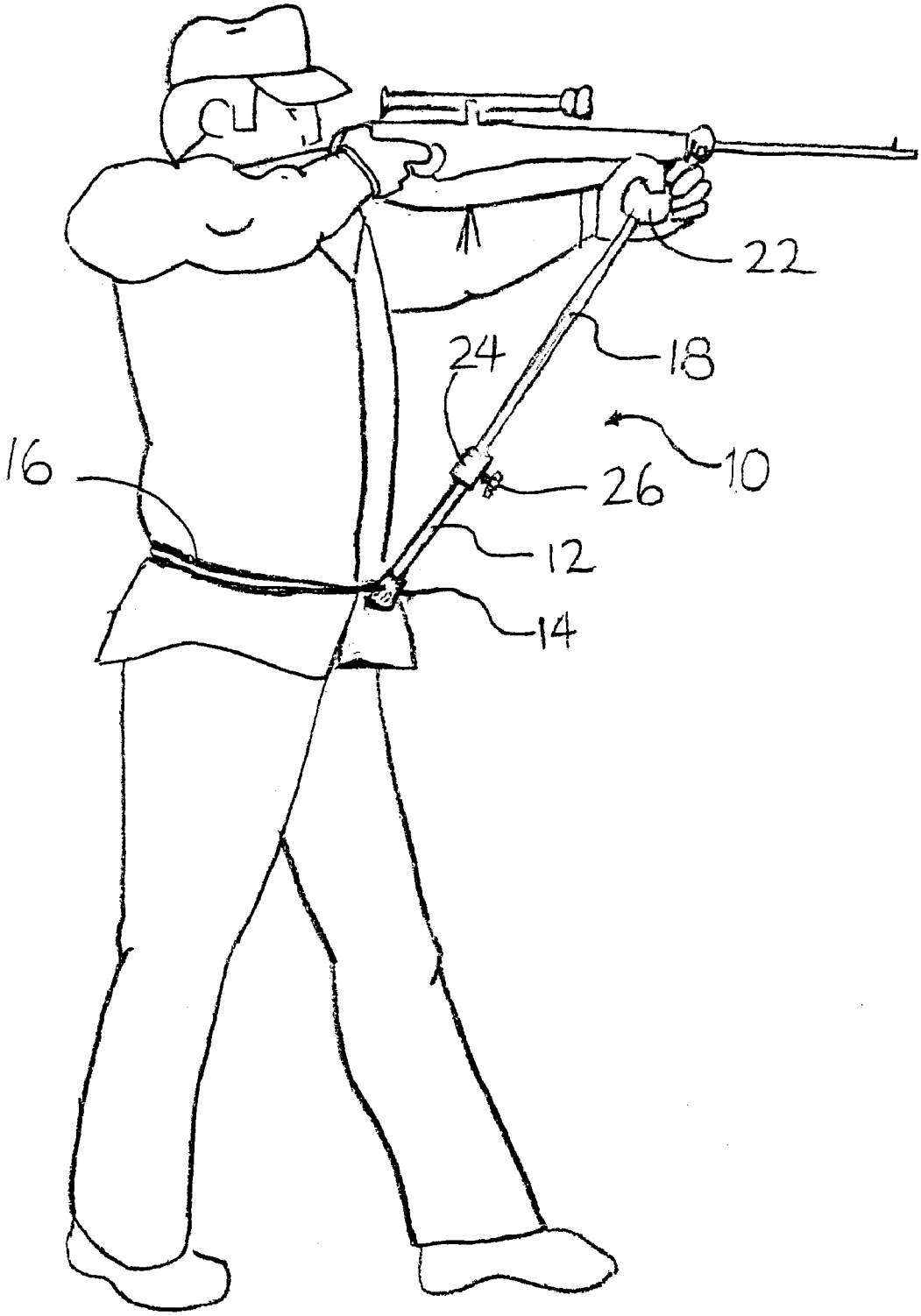
FIG. 3 is a perspective view of the hunters armrest illustrated in FIG. 1*a* in operation.

In operation, the hunters armrest 10 illustrated in FIG. 1*a*, is attached to the user by the strap 16 extending around the user's waist as shown in FIG. 3. The strap 16 may be tied around the user's waist or may include belt buckle type coupling or any other conventional attaching mechanism for attaching the strap 16 around the waist of the user. The first upper rod 18 is telescopingly received in the base rod 12 and secured in the appropriate position relative to the base rod 12 by tightening of the set screw 26. The spherical ball 22 provides a steady, grippable member for the hunter. As shown in FIG. 3, a hunter using a rifle can extend his arm and grip the spherical armrest member 22. This forms a very stabile triangular support configuration consisting of the user's extended arm, the user's torso and the hunters armrest 10 as shown in FIG. 3. The user's weapon can be steadied on the upper portion of the user's hand and prevented from lateral movement relative to the hunters armrest 10 by the thumb and forefinger of the user. With the strap 16 encircling the user's waist, the strap 16 essentially will pivotably attach the base rod 12 to the user so that the user can move his extended arm slightly into a comfortable shooting position.

The first upper rod 18 may be formed from either steel or other appropriate material which has the required strength. The spherical armrest member 22 may be formed out of wood to form a comfortable easily gripped member which does not act as a heat sink for the hunter's hand.

Figure 2:
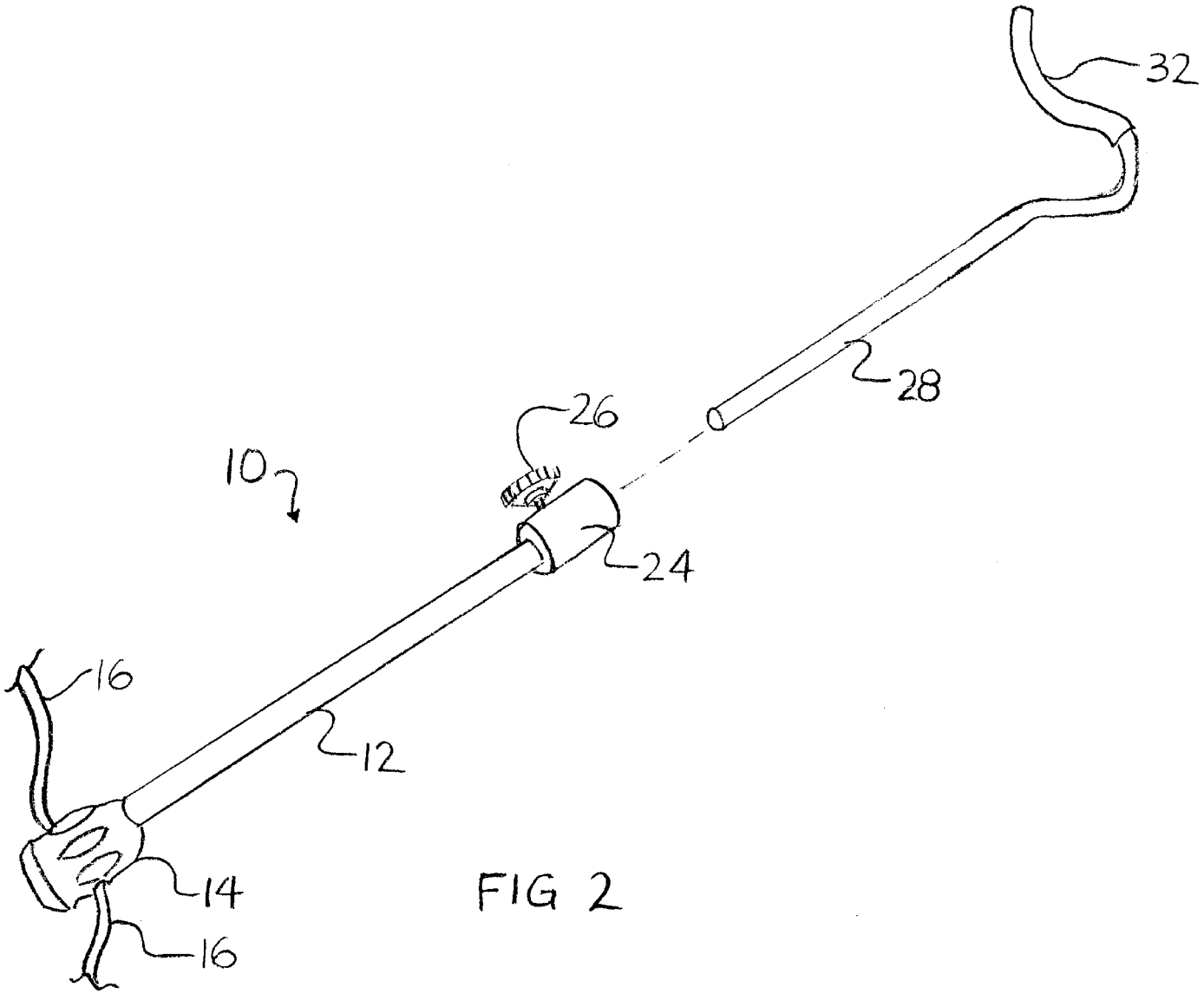
FIG. 2 is a perspective view of the base rod illustrated in FIG. 1*a* and 1*b* and a second upper rod forming a hunters armrest according to the present invention.

FIG. 2 illustrates the hunters armrest 10 with a second upper rod 28 for use with the base rod 12 of the present invention. The second upper rod 28 is slidably received within the hollow interior 20 of the base rod 12 in the same manner of the first upper rod 18 shown in FIG. 1*a*. The second upper rod 28 includes a different shaped armrest member 32 at the distal end thereof. The armrest member 32 extends away from the longitudinal axis of the base rod and includes a concave portion as shown in FIG. 2. As shown in FIG. 2 an upper end of the second upper rod 28, which is extending to the armrest member 32, will bend away from the longitudinal axis of the base member 12. This bending of the upper portion of the second upper rod 28 will help center the load on the hunters armrest 10 as better illustrated in FIGS. 4 and 5.

Figure 4:
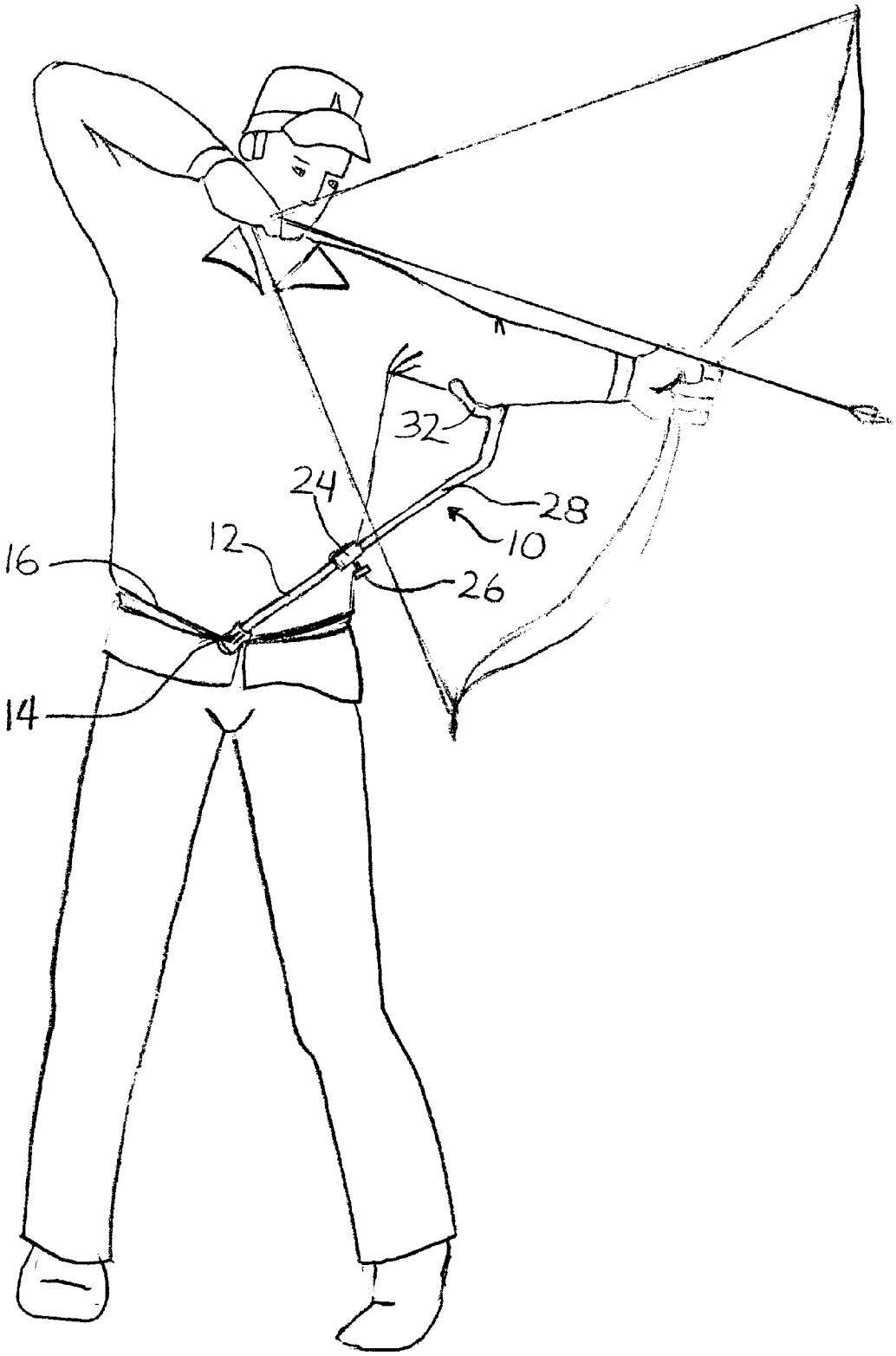
FIG. 4 is a perspective view of the hunters armrest illustrated in FIG. 2 in operation in a front support position.
Figure 5:
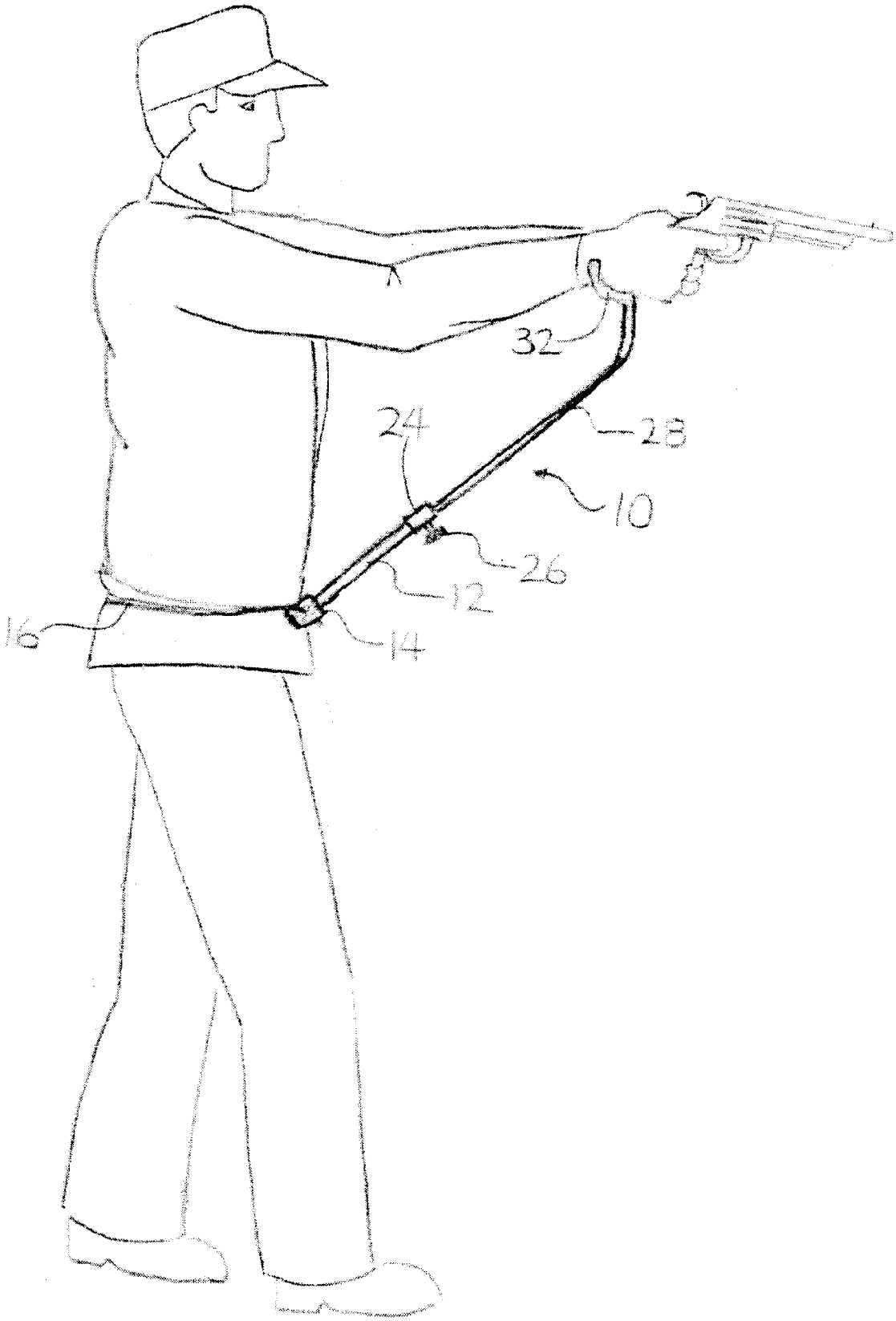
FIG. 5 is a perspective view of the hunters armrest illustrated in FIG. 2 in operation in a second support position.

As illustrated in FIGS. 4 and 5, the second upper rod 28 provides a distinct type of armrest member 32 which has the concave portion for receiving the user's arms or hands. In operation, the hunters armrest 10 illustrated in FIG. 2 operates the same as the hunters armrest illustrated in FIGS. 1*a* and 2. Specifically, the second upper rod 28 is telescopingly received within the base rod 12 at the appropriate position and secured by the tightening of set screw 26. The hunters armrest 10 will form a triangular support with the user's torso and the extended arm of the user. As shown in FIG. 4 the hunters armrest 10 may be used to support the upper arm of the user such as in shooting a bow. Alternatively, the wrist and hands of the user may be supported by the hunters armrest 10 for shooting a pistol as shown in FIG. 5.

It is intended that the hunters armrest 10 of the present invention be supplied with at least the first upper rod 18 and the second upper rod 28 together with the base rod 12 and strap 16. With this combination, the sportsman obtains a very versatile armrest useable with a variety of weaponry. It should be apparent to those of ordinary skill in the art that various modifications may be made to the present invention without departing from the spirit and scope thereof. For example, it is anticipated that various different shaped armrest members may be provided. It is further anticipated that the armrest member may be designed to be attached directly to a specific weapon. The scope of the present invention is defined in the appended claims together with equivalents thereto.

What is claimed is:

1. A portable arm rest comprising:

a base rod having a first end and an opposed second end;

a strap coupled to said first end of said base rod, said strap adapted to attach said arm rest to the user; and a plurality of upper rods, each said upper rod having an arm rest member at one end thereof, and each said upper rod adapted to be adjustably attached to said second end of said base rod, and wherein each said upper rod has a differently shaped arm rest member than said arm rest members of the remainder of said plurality of upper rods, wherein said plurality of upper rods is adapted for use with a variety of weaponry, wherein said arm rest member of one said upper rod is a spherical ball.

2. The armrest as set forth in claim 1 wherein each said upper rod is telescopingly received within said opposed second end of said base rod.

3. The armrest as set forth in claim 1 wherein said strap pivotably supports said base rod relative to the user.

4. The armrest as set forth in claim 1 wherein said arm rest member of one said upper rod extends away from a longitudinal axis of said base rod.

5. The armrest as set forth in claim 4 wherein an upper part of said one said upper rod is bent away from said longitudinal axis of said base rod, and wherein said armrest member includes a concave portion.

6. A hunter's arm rest comprising:

a means for attaching said arm rest to the hunter;

a base member supported at one end thereof to said attaching means;

at least one upper member adapted to be adjustably attached to said base rod; and an arm rest member on a distal end of each said upper member wherein said arm rest member of one of said at least one upper member is a spherical ball.

7. The hunter's armrest as set forth in claim 6 wherein said attaching means includes a strap extending through said one end of said base member.

8. The hunter's armrest as set forth in claim 6 wherein each said upper member is telescopingly received within a second end of said base member.

9. The hunter's armrest as set forth in claim 6 wherein at least a second said upper member is provided, each said upper member having a different arm rest member and adapted for use with different weaponry.

10. The hunter's armrest as set forth in claim 9 wherein said arm rest member of one of said at least one upper member extends away from a longitudinal axis of said base member.

11. The hunter's armrest as set forth in claim 10 wherein an upper part of said one upper member is bent away from said longitudinal axis of said base member, and wherein said armrest member includes a concave portion.

* * * * *